US008708185B2

(12) United States Patent
Sele et al.

(10) Patent No.: US 8,708,185 B2
(45) Date of Patent: Apr. 29, 2014

(54) SUPPORTS FOR TANKS

(75) Inventors: Arne Barrett Sele, Hosle (NO); Trygve Johannes Lund, Olso (NO)

(73) Assignee: Aker Engineering & Technology AS, Lysaker (NO)

( * ) Notice: Subject to any disclaimer, the term of this patent is extended or adjusted under 35 U.S.C. 154(b) by 1 day.

(21) Appl. No.: 13/505,276

(22) PCT Filed: Oct. 29, 2010

(86) PCT No.: PCT/NO2010/000391

§ 371 (c)(1),
(2), (4) Date: Sep. 19, 2012

(87) PCT Pub. No.: WO2011/053158

PCT Pub. Date: May 5, 2011

(65) Prior Publication Data

US 2013/0048642 A1 Feb. 28, 2013

(30) Foreign Application Priority Data

Oct. 29, 2009 (NO) ..... 20093245
Jul. 2, 2010 (NO) ..... 20100970

(51) Int. Cl.
*F17C 3/00* (2006.01)
*F17C 13/00* (2006.01)
*B65D 90/12* (2006.01)

(52) U.S. Cl.
USPC ..... 220/562; 220/630; 220/628; 220/560.11; 220/560.07; 114/74 T; 114/74 A

(58) Field of Classification Search
USPC ..... 114/74 A, 74 T; 220/560.05, 560.07, 220/560.1–560.11, 628–630, 636, 638, 901
See application file for complete search history.

(56) References Cited

U.S. PATENT DOCUMENTS 3,071,094 A * 1/1963 Lcroux ..... 114/74 A
3,305,122 A * 2/1967 Pringle ..... 220/560.07
3,583,351 A 6/1971 Gorman
3,612,333 A * 10/1971 Cowles ..... 220/560.11
3,800,970 A * 4/1974 Jackson ..... 220/560.08
3,830,181 A * 8/1974 Tornay ..... 114/74 A (Continued)

FOREIGN PATENT DOCUMENTS

JP 2003 252287 9/2003
JP 2003252287 A * 9/2003

OTHER PUBLICATIONS

International Search Report for Int'l App. No. PCT/NO2010/000391—Date of Completion of Search Jan. 13, 2011, 2 Pages.

(Continued)

*Primary Examiner* — Mickey Yu
*Assistant Examiner* — Brijesh V. Patel
(74) *Attorney, Agent, or Firm* — Locke Lord LLP

(57) ABSTRACT

A support assembly mounted on the roof of a tank comprising a support block, a base plate between the support block and the tank, and guiding brackets or rails joined to a structure above the tank. The guiding brackets or rails comprise a face turned towards a cooperating face of the support block. The face of the bracket or rail and the cooperating face of the support block are inclined at an angle which depends on the width and height of the support block.

5 Claims, 2 Drawing Sheets

(56) References Cited

U.S. PATENT DOCUMENTS

| | | | | | |
|---|---|---|---|---|---|
| 3,830,396 | A | * | 8/1974 | Jackson | 220/560.07 |
| 4,013,030 | A | * | 3/1977 | Stafford | 114/74 A |
| 4,173,936 | A | * | 11/1979 | Secord et al. | 114/74 A |
| 4,488,500 | A | * | 12/1984 | Mototsuna et al. | 114/74 A |
| 5,375,547 | A | * | 12/1994 | Abe et al. | 114/74 A |
| 5,531,178 | A | | 7/1996 | Abe | |
| 2003/0057214 | A1 | * | 3/2003 | Miller et al. | 220/565 |
| 2003/0066834 | A1 | * | 4/2003 | Enright, Jr. | 220/9.4 |

OTHER PUBLICATIONS

Norwegian Search Report for Norwegian App. No. 20100970—date of Report: Oct. 18, 2010 , 2 pages.

* cited by examiner

SUPPORTS FOR TANKS

FIELD OF INVENTION

The present invention relates to tanks for storage and transportation of fluids such as hydrocarbons, including low temperature liquefied natural gas. This includes tanks for ships and floating offshore structures exposed to wave loads as well as gravity based offshore structures and land tanks exposed to earthquakes.

BACKGROUND OF THE INVENTION

Supports on the roof of tanks restrain the structure at roof level to limit the loads experienced by the tank due to heeling, pitching or collision and in the case of tanks supported on a rigid base the effect of earthquakes.

Such tanks may be supported by timber supports of various types or supports of similar materials. The present technology for anchoring such supports to the top of the tank is to weld on vertical guide rails or brackets and similar rails or brackets on the roof of the hull. These brackets principally restrain transverse shear load and allow the tank to contract thermally while maintaining parallel supports by the rails.

U.S. Pat. No. 5,531,178 A discloses supports on the roof of tanks. The supports are anchored to the top of the tank by welding.

OBJECT OF THE INVENTION

The object of the present invention is to provide a support which is prevented from overturning, and thereby making it possible for said support to be mounted on the roof of a tank without the use of potentially fatigue inducing welding on the top of said tank.

SUMMARY OF THE INVENTION

The object of the present invention is obtained by anchoring the supports into moderately inclined welded rails or brackets. By providing brackets with a suitable inclination and a support with a suitable width the centre of the compressive force will fall within the base of the support preventing uplift and overturning of the support block. This arrangement allows the transverse load due to sea motion to be anchored in a rib and by direct compression on the tank.

For aluminium tanks exposed to fatigue it is desirable to anchor supports without welding. Welds may cause fatigue crack initiation which is a critical consideration for tanks containing liquefied gas. By anchoring the supports with for instance extruded ribs, the ribs being an integral part of the roof of the tank, fatigue of the tank is very significantly improved. Extruded ribs, or ribs formed by rolling, are base metal and are far better to resist fatigue and crack propagation than similar structures formed by welding to the tank. The supports are for instance placed in shallow welded boxes with a groove with which the rib, on the roof of the tank, mates. Fatigue cracks initiating in the support-box will not propagate into the tank and will not become a threat to safety.

The present invention is defined by:

A support assembly mounted on the roof of a tank, comprising a support block , a base plate between the support block and the tank, and guiding brackets or rails joined to a structure above the tank, characterized in that each of the brackets or rails comprise a face turned towards a cooperating face of the support block, the face of the bracket or rail and the cooperating face of the support block are inclined at an angle, said angle depending on the width and height of the support.

In a preferred embodiment of the support assembly, the faces of the rails or brackets turned towards the support block, and the corresponding faces on said support block, are leaning towards the uppermost centre of said support block, to the same degree with respect to the vertical.

In one embodiment of the support assembly, the base plate of the support block is secured to the roof of the tank by a rib.

In one embodiment of the support assembly the rib is an integral part of the roof of the tank.

In one embodiment of the support assembly, the rib is formed by extrusion or rolling.

In one embodiment of the support assembly, the base plate comprises ribs attached at each end of said plate.

In one embodiment of the support assembly, the base plate comprises a groove on the side facing the tank. The groove is dimensioned to accommodate a rib on the roof of the tank.

In preferred embodiments of the support assembly, the inclination angle is within the range of 8-25°, preferably within 10-20° and more preferably within 12-17°.

In preferred embodiments of the support assembly, the ratio of the width to the height of the support is within the range of 2.0-5.0, preferably within the range of about 2.5 to about 4.5, and more preferably within the range of about 3 to about 4.

BRIEF DESCRIPTION OF THE DRAWING

Further details of the invention will be described below with reference to the exemplifying embodiments shown schematically in the appended drawings, wherein.

DETAILED DESCRIPTION OF THE DRAWING

Figure 1:
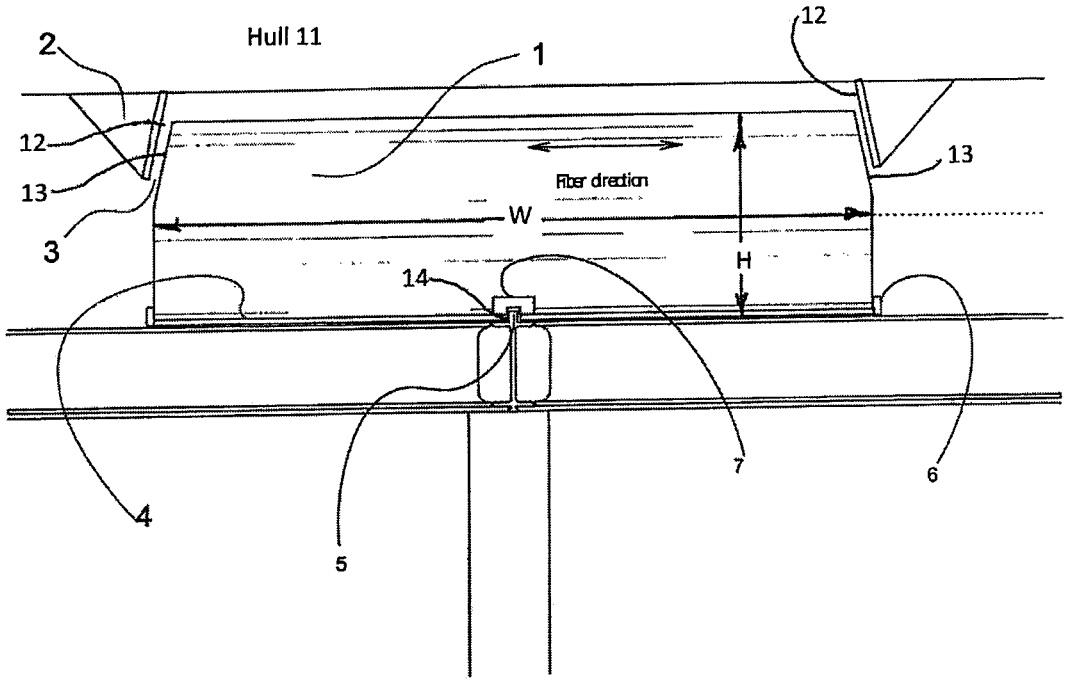
FIG. 1 shows a cross section of a support assembly with an inclined face.

FIG. 1 shows a cross section of the support assembly. The support block 1 has a width W and a height H and is made from timber or other suitable material. The timber support block is constrained by inclined guiding brackets or rails 2 welded to the hull structure. It is also constrained by a base plate 4 with ribs 6 attached at each end of the base plate 4. The base plate is welded to a narrow rail 7 which accommodates an extruded rib 5 Through a groove 14 in the base plate 4. The rib 5 is part of an extruded beam element from which the tank is fabricated. Due to the low temperature of the cargo tank when in operation, the tank will contract causing a modest gap 3 to develop between the inclined face 12 of the guiding bracket or rail 2 and the inclined face 13 of the support block 1. By making the support block wide, the angle of inclination will be limited, and so will the gap.

Figure 2:
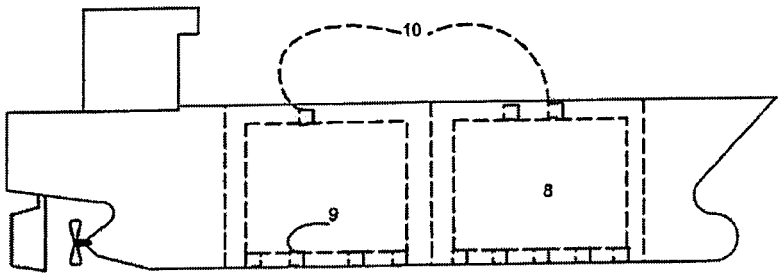
FIG. 2 shows a longitudinal section of a gas carrier with internal tanks.

FIG. 2 shows a longitudinal section of a gas carrier with internal tanks 8, bottom supports 9 and supports above the tank roof 10.

Figure 3:
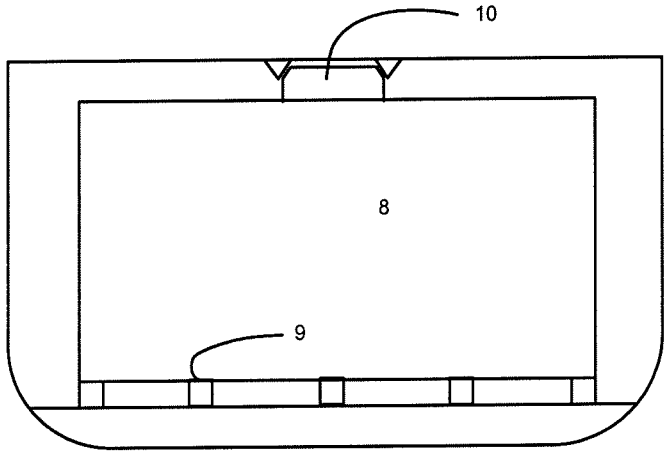
FIG. 3 shows a transverse section of a gas carrier with internal tanks.

FIG. 3 shows a transverse section of a gas carrier with internal tanks 8, bottom supports 9 and supports above the tank roof 10.

The invention claimed is:

1. A tank comprising a support assembly mounted on the roof of said tank, the support assembly comprising a support block and guiding brackets or rails joined to a structure above the tank, each of the guiding brackets or rails comprise a face turned towards a cooperating face of the support block, wherein the face of the guiding bracket or rail and the cooperating face of the support block are inclined at a substantially similar angle based on the width and height of the support block, and wherein the support assembly has a base plate between the support block and the tank, said base plate being secured to the roof of the tank without welding and by a rib which is an integral part of the roof of the tank and formed by extrusion or rolling.

2. The tank according to claim 1, wherein the base plate comprises ribs attached at each end of said base plate.

3. The tank according to claim 1, wherein the base plate comprises a groove on the side facing the tank.

4. The tank according to claim 1, wherein said substantially similar angle is within the range of 8-25°.

5. The tank according to claim 1, wherein the ratio of the width to the height of the support block is within the range of 2.0-5.0.

* * * * *